United States Patent [19]

Brush et al.

[11] 4,041,425

[45] Aug. 9, 1977

[54] MINIATURE LOW PROFILE RELAY

[75] Inventors: Douglas J. Brush, Villa Park; David L. Vonder, Addison; Anthony J. Wilkis, Downers Grove, all of Ill.

[73] Assignee: GTE Automatic Electric Laboratories Incorporated, Northlake, Ill.

[21] Appl. No.: 587,937

[22] Filed: June 18, 1975

[51] Int. Cl.[2] ..... H01H 67/02

[52] U.S. Cl. ..... 335/129; 335/132; 335/276

[58] Field of Search ..... 335/128, 129, 132, 187, 335/192, 276, 234

[56] References Cited

U.S. PATENT DOCUMENTS

| | | | |
|---|---|---|---|
| 2,608,630 | 8/1952 | Harrison | 335/129 |
| 3,518,592 | 6/1970 | Bosch | 335/234 |
| 3,553,729 | 1/1971 | Mori et al. | 335/192 |

*Primary Examiner*—George Harris

[57] ABSTRACT

A low profile relay having both coil and spring pile-up mounted in the same plane on its E-core. The E-core has two extended outer arms upon which the spring pile-up is mounted and a shorter center arm upon which the coil and bobbin assembly is mounted and which also forms the strike area for the armature. A C-shaped adjustable armature spring has brackets on each end of the arms into which the armature is snap fitted, providing an adjustable and detachable armature and spring assembly. A dust cover is mounted over the assembly with a hole above the coil to provide heat dissipation for the relay. The relay assembly is mounted on a non-metallic friction fit bottom insulator for mounting on printed wiring cards.

15 Claims, 14 Drawing Figures

MINIATURE LOW PROFILE RELAY

BACKGROUND OF THE INVENTION

1. Field of the Invention

The invention relates to low profile relays, and more particularly to low profile relays adapted for mounting on printed wiring cards (PWC's).

2. Description of the Prior Art

Current interest in the use of printed wiring cards (PWC's) has brought about a need for a relay which may be mounted on these cards. A particular problem in mounting relays on PWC's is that the card file holders for PWC's are set up so that the PWC's are mounted very closely together. This necessitates having a relay which is of extremely low profile. The close proximity also presents a heat dissipation problem.

Some other problems presented by existing techniques in use today are the metallic mounting plates on which most relay parts are mounted. This is added bulk, an additional part, and would of course short circuit the PWC circuits. No adjustment has been previously provided for the hinge leaf springs and the proper alignment of the armature and leaf springs has also been a problem. A further problem has been presented by the welding or riveting of the armature to the hinge leaf spring which has resulted in undesirable stresses being introduced in the armature magnetic flux lines.

SUMMARY OF THE INVENTION

The above and other disadvantages of the prior art low profile relays are overcome in accordance with the present invention by providing an elongated E-core assembly which allows mounting of the spring pile-up on the E-core itself. The low profile relay consists of the elongated E-core which has two outer arms extending beyond the center arm with mounting attachments on each end for the the spring pile-up. A molded plastic bobbin slips over the center arm and is provided with an armature back stop and may also be provided with a snap over piece to secure it to the E-core. The armature hinge spring is mounted on top of the E-core and is a one piece C-shaped spring with an adjustment point on each arm and armature mounting brackets on the end of each arm. The armature itself is an H-shaped piece with projections on each of the rear arms to engage the mounting brackets on the hinge spring, a center portion of the H is flattened to make a good strike contact area for the center arm of the E-core, and two forward arms are provided with notches to hold the actuator card in place. The spring pile-up is preassembled and is of a permissive make contact actuation type. The spring pile-up is mounted on a nonmagnetic mounting bar which then may be mounted on the two extended arms of the elongated E-core. The relay is then mounted on a thin insulator board which is prevented from slipping off the relay by two offset contact lead holes in the board. A dust cover, including a heat dissipation opening for dissipating heat from the coil, may then be snapped over the whole device which is then ready to be mounted on a PWC.

It is thus an object of the invention to provide an improved low profile relay for PWC mounting.

A second object of the invention is to provide a low profile relay which is less than four tenths of an inch in height.

A third object of the invention is to provide a low profile relay with an adjustable single piece C-shaped armature spring.

A fourth object of the invention is to provide a low profile relay with an armature spring with armature mounting brackets for detachably mounting the armature to the spring.

A fifth object of the invention is to provide a low profile relay with permissive make contact actuation.

A sixth object of the invention is to provide a snapon bobbin with an armature stop for a low profile relay.

A seventh object of the invention is to provide a cover with a heat dissipation opening for a low profile relay.

An eighth object of the invention is to provide a thin nonslipoff bottom insulator for low profile relays.

A ninth object of the invention is to provide an armature spring for a low profile relay which is easily aligned.

A tenth object of the invention is to provide a preassembled spring pile-up which may be easily mounted on the E-core of a low profile relay in the same plane as the coil.

Other objects, advantages, and novel features of the invention will become apparent from the following detailed description of the invention when considered in conjunction with the accompanying drawings.

DESCRIPTION OF THE PREFERRED EMBODIMENT

Figure 1:
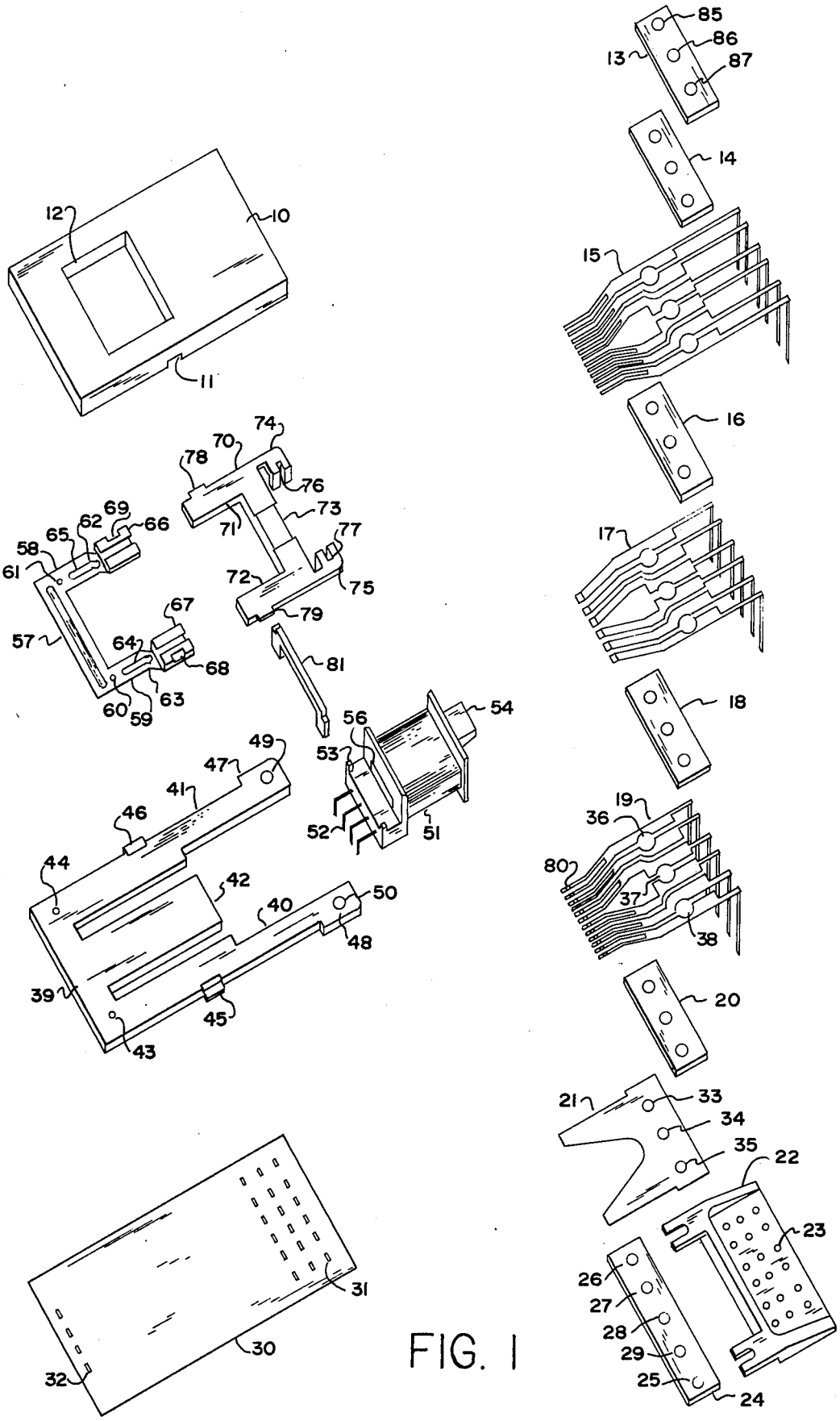
FIG. 1 is a perspective view of the disassembled low profile relay.

Referring to FIG. 1, a low profile relay is shown in an unassembled perspective. Cover 10 is shown with a notch 11 for mounting on the E-core and a hole 12 which is positioned over the coil to dissipate heat from the relay. On the right the various parts of the spring pile-up assembly are seen. These include a top clamping plate 13 with three tapped screw holes 85, 86, and 87. Mounted below this is a nonconductive insulator 14 which secures the top contact set 15 above another insulator 16 and center contact set 17. Next is another insulator 18 which separates contact set 17 from contact set 19. The contact springs have raised contact areas as shown at 80 and they further have enlarged circular openings as shown at 36, 37, and 38 to avoid contact with the metal screws which secure the assembly. A bottom insulator 20 separates contact set 19 from the return spring 21 which also has enlarged holes 33, 34, and 35 to avoid short circuiting with the metal screws, as do contact sets 15 and 17. A bottom nonmagnetic metal mounting bar 24 includes holes 25 and 26 for mounting the assembly to the E-core 39 and tapped holes 27, 28, and 29 for preassembling parts 13 through 21 onto mounting bar 24 before mounting on the relay E-core. A spacer 22 mounts between the mounting bar 24 and the E-core arms 41 and 40. The spacer contains holes 23 through which the spring contact leads are inserted.

The heart of the relay is a metallic E-core 39. The E-core includes elongated arms 40 and 41 and a much shorter center arm 42. Also shown are two posts 43 and 44 formed by semi-perforating the E-core and tabs 45 and 46 which are formed by extruding material from the E-core arms. The ends of the E-core arms 47 and 48 contain tapped holes 49 and 50 corresponding to holes 26 and 25 on the mounting bar 24 by which the spring pile-up is mounted to the E-core.

The coil bobbin is shown at 51 and includes coil lead 52 and may include an upward projection 53 used as a snapon holder for the bobbin over the E-core end. An armature stop 54 limits release travel of the armature and a hollow core of the bobbin 56 permits it to be mounted on E-core member 42. A C-shaped adjustable armature spring 57 includes two holes 60 and 61 which permit the spring to be mounted over projections 43 and 44 on the E-core. Arms 58 and 59 contain holes 64 and 65 which extend through the bend shown at 62 and 63 to permit adjustment of the spring tension. At the end of each arm is a bracket as shown at 66 and 67 formed by bending of the ends into an open rectangle with each containing a notch on the upper outer side as shown at 68 and 69. The armature itself is shown at 70 including arms 71 and 72 containing projections 78 and 79 which slide into and snap into holes 68 and 69 in the armature spring. Also shown is indented area 73 which gives a flat striking area which strikes on the end of E-core arm 42. Arms 74 and 75 include notch projections 76 and 77 which secure the actuator card 81. When fully assembled the relay is mounted on insulator base 30 which has holes shown at 31 and 32 for the spring contact leads and the bobbin coil leads respectively.

Figure 2:
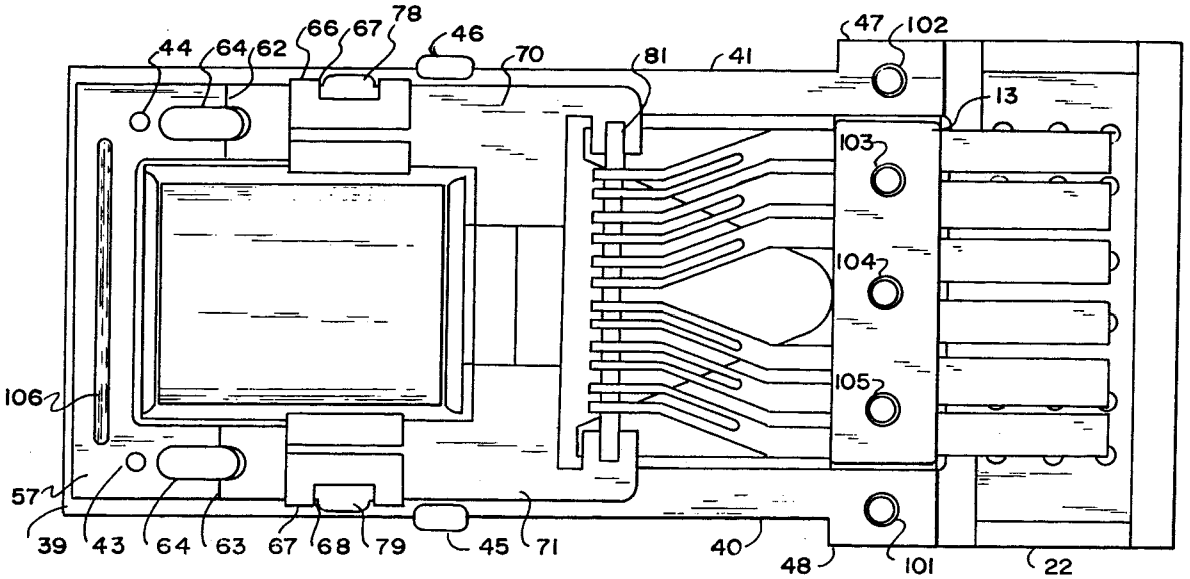
FIG. 2 is a top view of the assembled relay without the cover.
Figure 3:
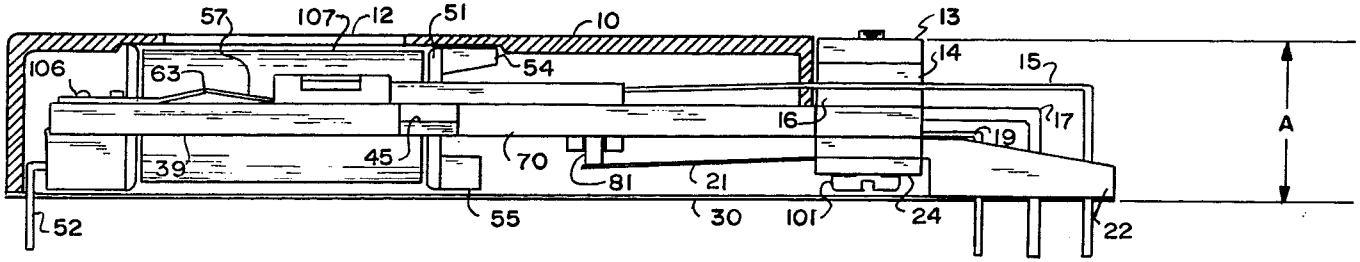
FIG. 3 is a side view of the assembled relay with a sectional view of the cover.

FIGS. 2 and 3 show the fully assembled low profile relay. FIG. 2 is a top view without the relay cover with corresponding numbers going to corresponding elements as were shown in FIG. 1. Shown at 55 is a bottom support member for the bobbin 51. Element 106 shown in FIGS. 2 and 3 is a raised portion of the relay armature spring which is used to strengthen the spring. Screws shown at 101 and 102 are the mounting screws for the spring pile-up assembly and screws 103 through 105 are the screws used to preassemble the spring pile-up. The relay coil is shown at 107 and in FIG. 3 the cover is shown sectionalized and snapped down over the relay with most of it being used as a dust cover for the spring pile-up and the hole 12 being shown over the coil 107 for dissipating heat from the coil. Also shown in FIG. 3 is the relay height "a" which with the present invention can be less than four tenths of one inch in height. This is extremely advantageous for mounting in the close confines of the PWC environment.

Figure 4:
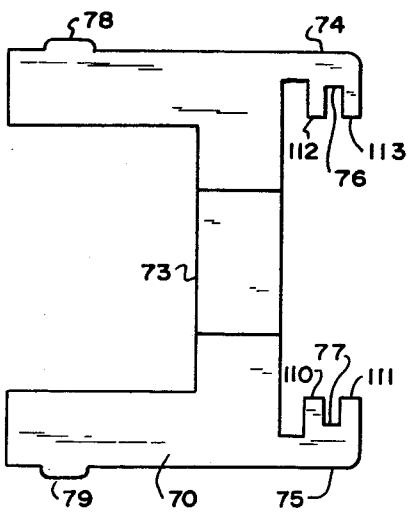
FIG. 4 is a top view of the armature.
Figure 5:
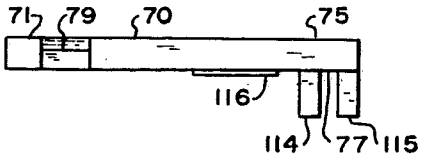
FIG. 5 is a side view of the armature.

FIGS. 4 and 5 are a top and a side view of the relay armature. FIG. 4 shows the inward extending arms 110 and 111 and 112 and 113 which form the respective notches 77 and 76 to hold the actuator card 81. As seen in FIG. 5 each of the inward extending arms 110–113 have downward extending parts 114 and 115 which further secure the armature card. Also more clearly shown in FIG. 5, is the flat downward extending portion 116 which provides a flat striking surface for the armature on the E-core arm 42. This indentation 116 makes sure that the armature has a flat strike on the E-core arm with no warp or tipping.

Figure 6:
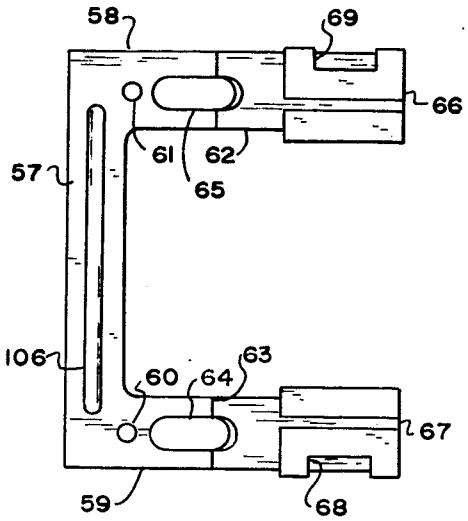
FIG. 6 is a top view of the armature spring.
Figure 7:
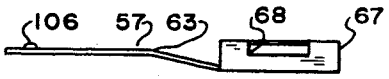
FIG. 7 is a side view of the armature spring.

FIGS. 6 and 7 show a top and a side view of the armature hinge spring. The spring is bent downward as shown at 62 and 63 and the holes in each arm 64 and 65 are provided for insertion of a tool to then adjust the spring tension for the armature assembly. As can be more clearly seen here, the brackets 66 and 67 on the ends of the armature spring have two folded up pieces forming a rectangle, including notches 68 and 69 into which the armature is snapped securely into position. This results in both ease of assembly during manufacture and elimination of undesirable stresses being introduced into the armature when the armature is riveted or welded to the hinge spring, and also of course removal is not possible with a riveted or welded armature and armature spring assembly. Also, the one piece C-shaped spring makes for easier assembly and greater accuracy in aligning the armature with the E-core. This also introduces less stress in the overall assembly.

Figure 8:
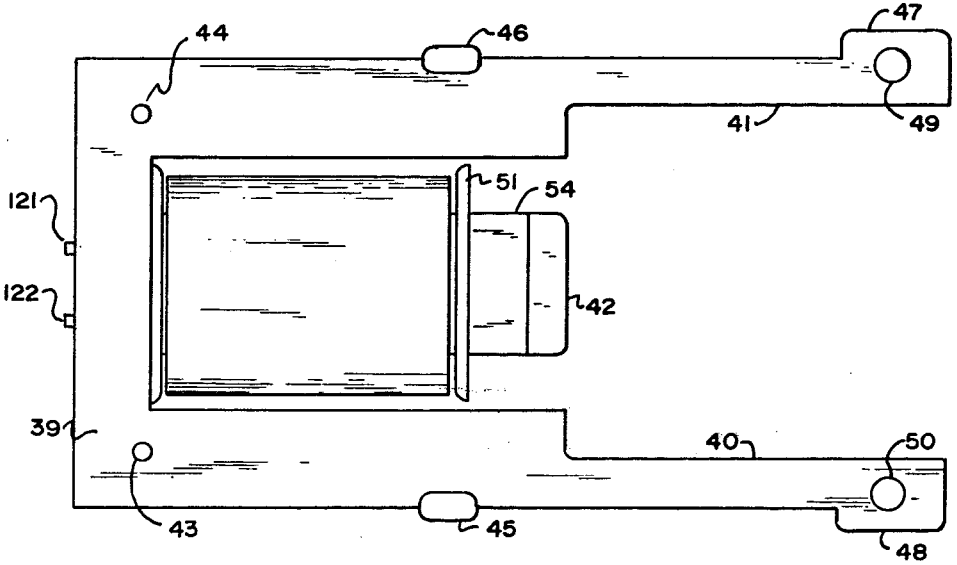
FIG. 8 is a top view of the E-core and coil (bobbin) assembly.
Figure 9:
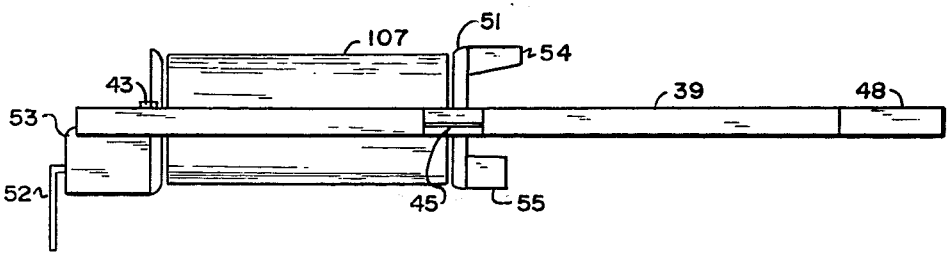
FIG. 9 is a side view of the E-core and coil assembly including a snapon bobbin.

FIGS. 8 and 9 are a top and a side view of the E-core and coil assembly with the coil 107 being mounted on the E-core assembly. In the top view two bobbin coil leads are shown at 121 and 122 (there may of course be more). In this particular case the bobbin would be conventionally glued to the E-core. In the side view in FIG. 9 however the snapon tab 53 is shown on the end of the bobbin 51. This allows for a quicker and cheaper assembly of the bobbin onto the E-core. There would typically be at least two of these snapon projections to secure the bobbin to the E-core.

Figure 10:
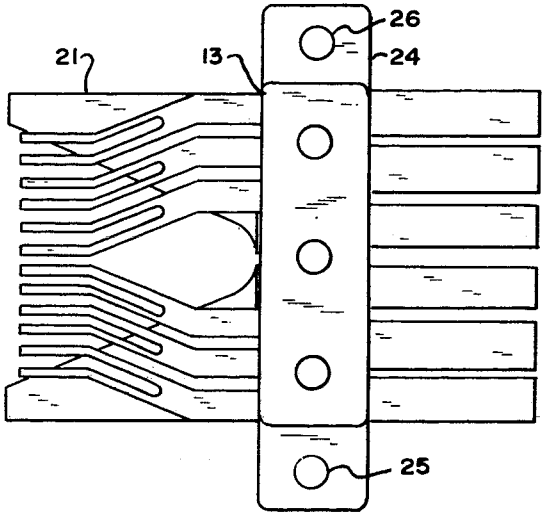
FIG. 10 is a top view of the spring pile-up assembly.
Figure 11:
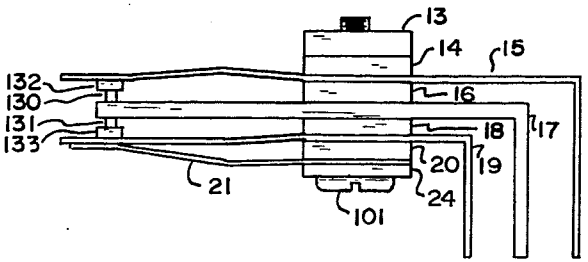
FIG. 11 is a side view of the spring pile-up assembly.

FIGS. 10 and 11 show a top and a side view of the assembled spring pile-up assembly. The make contact for each lead is shown at 132 and the break contact for each lead on the bottom is shown at 133. To make a sure contact these mate with contacts on center set 17 as shown at 130 and 131.

Figure 12:
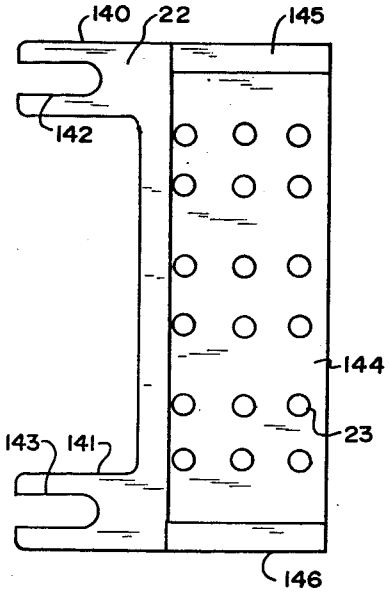
FIG. 12 is a top view of the spring pile-up assembly spacer.
Figure 13:
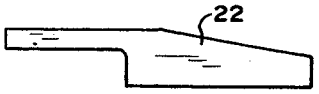
FIG. 13 is a side view of the spring pile-up assembly spacer.

Spacer 22 is shown in a top and side view in FIGS. 12 and 13. The spacer is used along with mounting bar 24 to mount the spring pile-up assembly on the E-core ends. The spacer would of course fit between the nonmagnetic mounting bar 24 and the E-core ends themselves. The mounting screws would be extended through slots 142 and 143 on arms 140 and 141. Inclining side pieces 145 and 146 are formed on either side of the flat area 144 to add support to area 144. Once assembled the contact leads would be projected through these holes as shown at 23.

Figure 14:
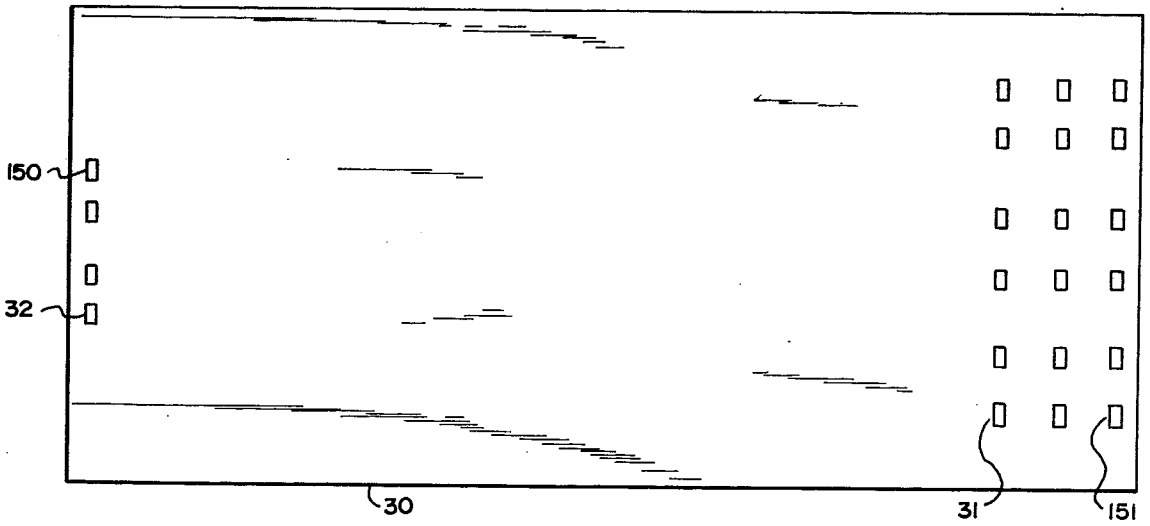
FIG. 14 is a top view of the bottom insulator for the relay assembly.

FIG. 14 shows the insulator 30 on which the whole relay assembly is mounted. This insulator may typically be one hundredth of an inch thick of a polyester film to provide separation from the circuits on the PWC when the relay is mounted. Holes shown at 31 are used for insertion of the spring contact lead ends and holes shown at 32 are used for insertion of the bobbin contact lead ends (here shown as four but they could of course be another number such as two as shown in the FIG. 8). The holes shown at 150 and 151 would be slightly skewed from the other holes providing a secure snapon insulator. This would allow for ease of assembly and by these two holes being slightly skewed, the insulator would not fall off before the relay is mounted on a PWC.

In a typical manufacturing operation the spring pile-up would of course be preassembled. Next the rest of the relay assembly would be assembled as follows:

1. Assemble spring pile-up card 81 to the armature 70 typically by squeezing the fingers on the armature against the card.

2. Snap the armature arms 71 and 72 into the hinge spring brackets 66 and 67.

3. Snap the wound coil and bobbin assembly 51 and 107 onto the E-core center arm 42.

4. Mount the hinge spring and armature assembly onto the E-core frame by placing projections 44 and 43 on the E-core through holes 60 and 61 of the armature spring and then typically stamping projections 43 and 44 to flatten them out to secure the armature spring.

5. Mount the spring contact pile-up assembly onto the E-core ends 49 and 48 using insulator 22 between the E-core arms and the mounting bar 24 and make sure actuator card 81 is positioned between the contact springs before fastening these screws through mounting holes 25 and 26 and the corresponding holes 49 and 50 on the E-core.

6. Adjust the spring tension using holes 64 and 65 at points 62 and 63 on the armature spring, if necessary.

7. Snap on the dust and heat dissipator cover 10.

8. Secure the insulator 30 to the bottom of the relay assembly by forcing it over the spring pile-up and bobbin terminal leads.

Obviously many modifications and variations of the present invention are possible in light of the above teachings. It is therefore to be understood that within the scope of the appended claims the invention may be practiced otherwise than as specifically described.

We claim:

1. A low profile relay comprising:

spring pile-up means including relay springs and contacts;

bobbin means for mounting a coil;

E-core means including two outer elongated arms and a center arm shorter than said two outer arms to provide a space coplanar with the arms for locating therein said spring pile-up means, said two outer arms supporting said spring pile-up means between them in said space coplanar with the arms and said center arm supporting said bobbin means;

armature spring means mounted on said E-core means; and armature means affixed to said armature spring means for actuating said contacts in cooperation with said coil.

2. A low profile relay as claimed in claim 1 wherein said armature spring means comprises:

a single piece C-shaped spring with a raised adjustment section on each arm.

3. A low profile relay as claimed in claim 2 wherein said armature means comprises:

an actuator card, an armature bar with a flat anti-tip section, two arms perpendicular to said armature bar each of which has a projection at its outer extremity, and the opposite side of said armature bar contains two arms to hold said actuator card; and said armature spring means further comprising snapon spring means at the end of each of said C-arms for snapping over said armature bar arm projections to secure said armature to said armature spring;

whereby said armature means can be detachably mounted to said armature spring means.

4. A low profile relay as claimed in claim 1 wherein said bobbin means further comprises:

snapon means for snapping over the end of said E-core means to secure said bobbin to said center arm; and armature stop means to limit the release travel of said armature means.

5. A low profile relay as claimed in claim 1 wherein said spring pile-up means includes:

permissive make contact actuation means.

6. A low profile relay as claimed in claim 1 further comprising:

cover means for covering said relay including a heat dissipation opening over said coil; and said E-core means further includes a projection on each side;

whereby said cover may be snapped on to said projections to protect said unit from foreign matter.

7. A low profile relay as claimed in claim 1 further comprising:

nonslipoff bottom insulator means for insulating said relay from external circuits.

8. A low profile relay as claimed in claim 1 wherein:

said relay height is less than four tenths of one inch.

9. A low profile relay as claimed in claim 1 wherein:

said center arm extends far enough to also form the strike area for said armature means while allowing sufficient space for said relay springs and said contacts of said spring pile-up means.

10. A low profile relay as claimed in claim 1 wherein:

said spring pile-up means includes a mounting bar for mounting to said E-core means;

whereby said spring pile-up means may be preassembled on said mounting bar before mounting on said E-core means.

11. A low profile relay as claimed in claim 10 wherein:

said two outer elongated arms include mounting means on each end of said arms for mounting said spring pile-up means;

said armature spring means comprises;

a single piece C-shaped spring with a raised adjustment section on each arm;

said bobbin means comprises;

snapon means for snapping over the end of said E-core means to secure said bobbin to said center arm; and armature stop means to limit the release travel of said armature means; and said armature means comprises;

an actuator card, an armature bar with a flat anti-tip section, two arms perpendicular to said armature bar each of which has a projection at its outer extremity, and the opposite side of said armature bar contains two arms to hold said actuator card; and said armature spring means further comprise snapon spring means at the end of each of said C-arms for snapping over said armature bar arm projections to secure said armature to said armature spring;

whereby said armature means can be detachably mounted to said armature spring means.

12. A low profile relay as claimed in claim 11 wherein said spring pile-up and means includes:

permissive make contact actuation means.

13. A low profile relay as claimed in claim 11 further comprising:

cover means for covering said relay including a heat dissipation opening over said coil; and said E-core means further includes a projection on each side;

whereby said cover may be snapped on to said projections to protect said unit from foreign matter.

14. A low profile relay as claimed in claim 11 further comprising:

nonslipoff bottom insulator means for insulating said relay from external circuits.

15. A low profile relay as claimed in claim 11 wherein:

said relay height is less than four tenths of one inch.

* * * * *